US007868783B2

(12) United States Patent
Bachelder

(10) Patent No.: US 7,868,783 B2
(45) Date of Patent: Jan. 11, 2011

(54) CELLULAR-BASED PREEMPTION SYSTEM

(75) Inventor: Aaron D. Bachelder, Irvine, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 12/420,023

(22) Filed: Apr. 7, 2009

(65) Prior Publication Data

US 2009/0189782 A1 Jul. 30, 2009

Related U.S. Application Data

(63) Continuation of application No. 11/504,755, filed on Aug. 14, 2006, now abandoned, which is a continuation-in-part of application No. 10/811,075, filed on Mar. 24, 2004, now Pat. No. 7,327,280.

(60) Provisional application No. 60/707,934, filed on Aug. 12, 2005.

(51) Int. Cl.
*G08G 1/07* (2006.01)

(52) U.S. Cl. ..... 340/906

(58) Field of Classification Search ..... 340/906, 340/902, 903, 907, 916, 917, 933, 994; 701/300, 701/301, 302

See application file for complete search history.

(56) References Cited

U.S. PATENT DOCUMENTS

| | | | | |
|---|---|---|---|---|
| 5,043,736 | A * | 8/1991 | Darnell et al. | 342/357.1 |
| 5,539,398 | A * | 7/1996 | Hall et al. | 340/907 |
| 6,326,903 | B1 * | 12/2001 | Gross et al. | 340/988 |
| 2004/0196162 | A1 * | 10/2004 | Brooke | 340/906 |
| 2005/0035878 | A1 * | 2/2005 | Vassilevsky | 340/902 |

* cited by examiner

*Primary Examiner*—Phung Nguyen
(74) *Attorney, Agent, or Firm*—Christie, Parker & Hale, LLP

(57) ABSTRACT

A cellular-based preemption system that uses existing cellular infrastructure to transmit preemption related data to allow safe passage of emergency vehicles through one or more intersections. A cellular unit in an emergency vehicle is used to generate position reports that are transmitted to the one or more intersections during an emergency response. Based on this position data, the one or more intersections calculate an estimated time of arrival (ETA) of the emergency vehicle, and transmit preemption commands to traffic signals at the intersections based on the calculated ETA. Additional techniques may be used for refining the position reports, ETA calculations, and the like. Such techniques include, without limitation, statistical preemption, map-matching, dead-reckoning, augmented navigation, and/or preemption optimization techniques, all of which are described in further detail in the above-referenced patent applications.

20 Claims, 7 Drawing Sheets

CELLULAR-BASED PREEMPTION SYSTEM

CROSS-REFERENCE TO RELATED APPLICATION(S)

This application is a continuation application of U.S. application Ser. No. 11/504,755, filed on Aug. 14, 2006, now abandoned, which is a continuation-in-part of application Ser. No. 10/811,075, filed on Mar. 24, 2004, now U.S. Pat. No. 7,327,280, and claims the benefit of U.S. Provisional Application No. 60/707,934, filed on Aug. 12, 2005, the content of both of which are incorporated herein by reference. This application also contains subject matter which is related to the subject matter of U.S. Pat. No. 7,113,108, U.S. Pat. No. 7,116,245, U.S. application Ser. No. 10/696,490, now abandoned, and U.S. Pat. No. 7,089,806, the content of all of which are incorporated herein by reference.

STATEMENT REGARDING FEDERALLY SPONSORED RESEARCH OR DEVELOPMENT

The invention described herein was made in the performance of work under a NASA contract, and is subject of the provisions of Public Law 96-517 (35 U.S.C. §202) in which the Contractor has elected to retain title.

BACKGROUND OF THE INVENTION

There are various approaches for providing traffic signal priority for emergency vehicles (hereinafter referred to as "preemption") at an intersection. One approach uses strobe lights to activate optical receivers at the intersection. Another approach uses noise pattern recognition to preempt based on approaching sirens. Recent preemption systems make use of global positioning system (GPS) technology to predict the approach of the emergency vehicles at the intersection.

All of the above approaches, however, have their drawbacks. Strobe-based preemption generally requires an optical line-of-sight which may be obstructed by hills, turns, and the like. Furthermore, strobe-based preemption requires expensive receiver units and installation of the strobe lights and related equipment in the cars. The range of strobe-based preemption may also be limited to only a few hundred feet.

The drawbacks of preemption based on siren noises is that such noises may or may not be recognized depending on their direction and distance from the intersection. Their recognition may also be obstructed by ambient noises, such as, for example, traffic sounds, horns, and the like.

The drawbacks of a GPS-based preemption system is that the installation of the GPS devices in the emergency vehicles may be expensive. Even if installed, GPS position data may not always be readily available. For example, although GPS systems are effective in providing position data in light metropolitan and rural areas, such positions may be occluded by buildings, bridges, and the like, in large cities. GPS systems may also not be available during emergencies such as, for example, a terrorist event. GPS receivers are also more susceptible to jamming than most receivers. Nonetheless, a GPS preemption system, when available, is very effective in terms of timing and vehicle position determinations.

Accordingly, what is desired is a preemption system and method that helps overcome the drawbacks of prior preemption systems.

SUMMARY OF THE INVENTION

According to one embodiment, the present invention is directed to a system for controlling traffic for allowing passage of an emergency vehicle through an intersection controlled by traffic signals. The system includes a device, such as, for example, a priority code box coupled to the emergency vehicle, for placing the emergency vehicle in emergency mode (e.g. Code-2, Code-3, etc.). The code box also transmits a trigger signal responsive to the emergency vehicle being placed in the emergency mode. A cellular unit in the emergency vehicle receives the trigger signal and in response, generates position data for the cellular unit. A transmitter in the cellular unit or in a separate transponder box in the vehicle is used to transmit the generated position data for forwarding to the intersection controlled by the traffic signals.

According to one embodiment of the invention, an intersection module associated with the intersection is programmed to receive the generated position data, calculate the estimated time of arrival of the emergency vehicle based on the position data, and transmit one or more preemption commands for preempting the traffic signals based on the estimated time of arrival.

According to one embodiment of the invention, the intersection module is further programmed to receive real time status information of the traffic signals, monitor timing of traffic signal phases based on the received real time status information, and transmit the one or more preemption commands based on the monitored timing of the traffic signal phases.

According to one embodiment of the invention, the cellular unit includes a global positioning system (GPS) receiver for generating the position data.

According to one embodiment of the invention, the transmitter transmits the position data via a cellular network. The position data is transmitted without disabling use of the cellular unit for an active call.

According to one embodiment of the invention, the transmitter transmits the position data to a vehicle transponder, and the vehicle transponder forwards the position data to the intersection.

According to one embodiment of the invention, an on-board diagnostics circuitry coupled to the emergency vehicle provides vehicle speed and acceleration. Preemption of the traffic signals is then based the vehicle speed and acceleration.

According to one embodiment of the invention, one or more navigation sensor units coupled to the emergency vehicle provides vehicle navigation data. Preemption of the traffic signals is then based on the vehicle navigation data.

According to one embodiment of the invention, instead of the cellular unit generating the position data, the cellular unit transmits a location request to a cellular station and it is the cellular station that generates the position data of the cellular unit.

DETAILED DESCRIPTION

In general terms, the present invention is directed to a cellular-based preemption system that uses existing cellular infrastructure to transmit preemption related data to allow safe passage of emergency vehicles through one or more intersections. Specifically, a cellular unit in an emergency vehicle is used to generate position reports that are transmitted to the one or more intersections during an emergency response. Based on this position data, the one or more intersections calculate an estimated time of arrival (ETA) of the emergency vehicle, and transmit preemption commands to traffic signals at the intersections based on the calculated ETA.

Additional techniques may be used for refining the position reports, ETA calculations, and the like. Such techniques include, without limitation, statistical preemption, map-matching, dead-reckoning, augmented navigation, and/or preemption optimization techniques, all of which are described in further detail in the above-referenced patent applications.

Figure 1:
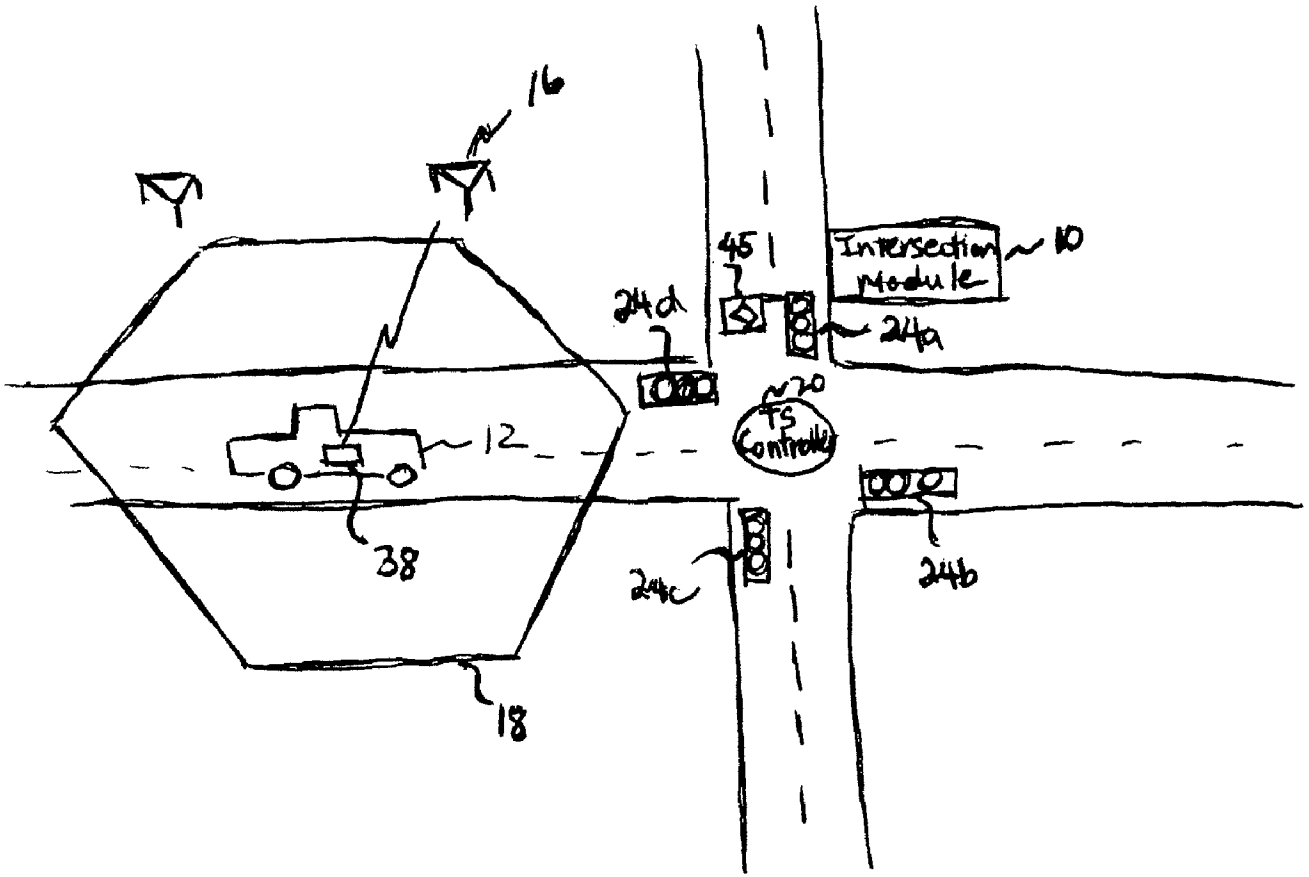
FIG. 1 is a schematic diagram of an intersection subject to preemption according to one embodiment of the invention.

FIG. 1 is a schematic diagram of an intersection subject to preemption according to one embodiment of the invention. Located at the intersection are traffic signal lights 24*a*-24*d* (collectively 24) controlled by a traffic light controller 20. An intersection module 10 coupled to the traffic light controller 20 makes preemption criteria calculations and generates preemption command(s) to give traffic signal priority to an approaching emergency vehicle 12. In the illustrated example, traffic signal light 24*d* is controlled to be green while traffic signal lights 24*a*, 24*b*, and 24*c* are controlled to be red, thereby allowing safe passage of the emergency vehicle 12 through the intersection. Pedestrian lights and pedestrian buttons are also controlled to prevent pedestrian traffic through the intersection when the emergency vehicle 12 has the right-of-way.

According to one embodiment of the invention, one or more emergency display panels 45 are activated to provide warning of the approaching emergency vehicle 12 to the surrounding vehicles and pedestrians. The display panels 45 are controlled to indicate the approach of the emergency vehicle as is described in further detail in U.S. Provisional Application No. 60/798,156, the content of which is incorporated herein by reference.

According to one embodiment of the invention, the emergency vehicle 12 includes a stationary cellular unit 38 installed within the emergency vehicle 12. The cellular unit 38 is configured to communicate with a cellular station 16 within a cell 18 of a cellular network. In another embodiment of the invention, the cellular unit 38 is a portable unit carried by an emergency responder in/on the emergency vehicle 12.

Whether stationary or portable, the cellular unit 38 may take the form of a cellular phone, personal digital assistant (PDA), vehicle service system (e.g. On-Star®), or any other device that uses cellular technology. The particular cellular technology used by the cellular network may include, for example, Global System for Mobile communications (GSM), General Packet Radio Service (GPRS), CDMA, TDMA, 3GPP (3rd Generation Partnership Project), and 3GPP2 (3rd Generation Partnership Project).

According to one embodiment of the invention, the cellular unit 38 is configured with a GPS receiver which provides position reports for the cellular unit in response to particular trigger signals received by the cellular unit. The position reports may include, for example, the cellular unit's position in the form of latitude/longitude coordinates. According to another embodiment of the invention, the cellular unit's position is determined by the cellular station 16 based on triangulation calculations. In this regard, the cellular unit transmits a position request to the cellular station(s), and the receiving cellular station(s) generate the position reports based on the triangulation calculations.

Figure 2:
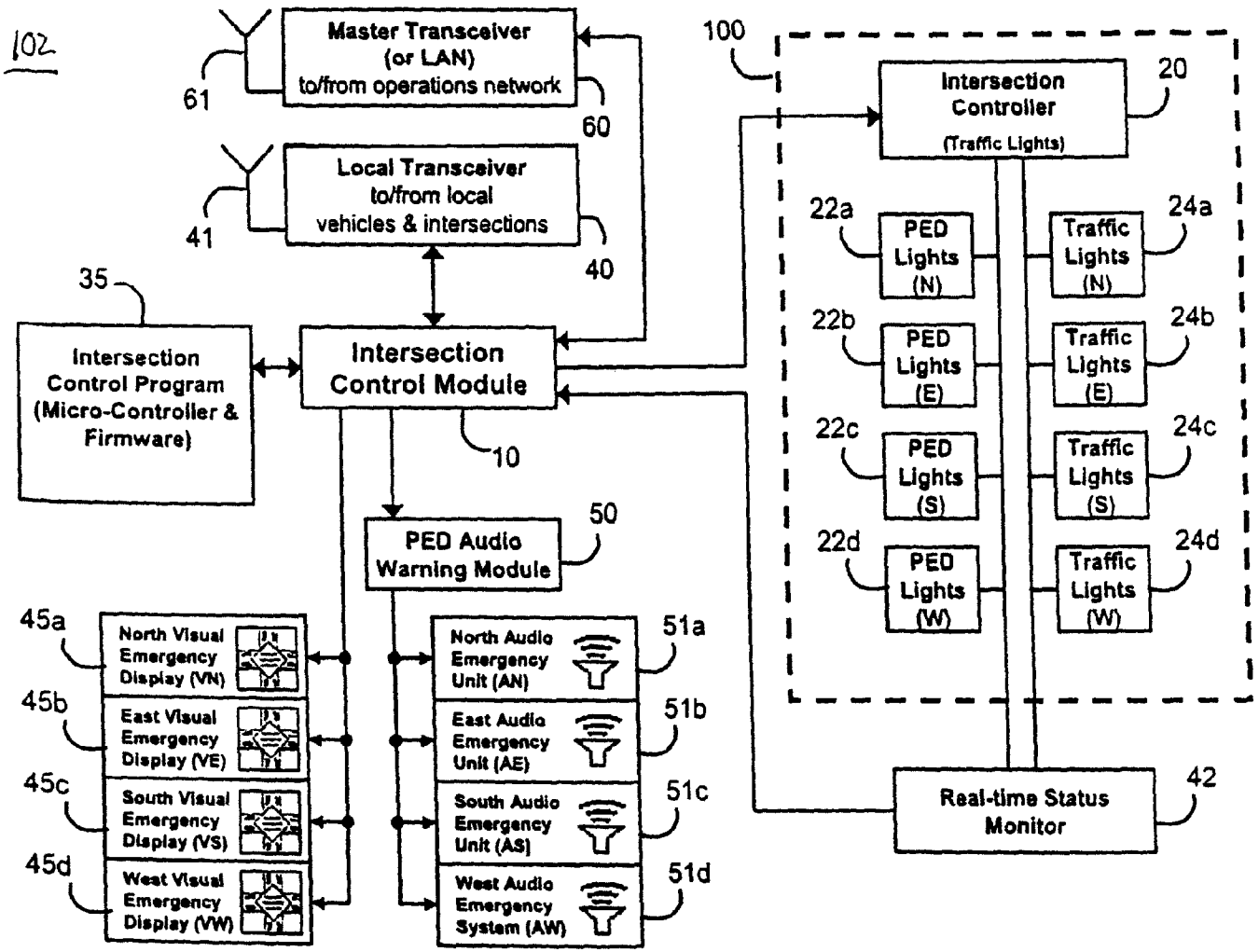
FIG. 2 is a more detailed block diagram of various intersection preemption modules operative for preempting an intersection according to one embodiment of the invention.

FIG. 2 is a more detailed block diagram of various intersection preemption modules 102 operative for preempting an intersection according to one embodiment of the invention. The intersection preemption modules 102 include a traffic light control system 100 including the traffic light controller 20 that controls the traffic and pedestrian signals at the intersection as well as any pedestrian buttons. Specifically, the traffic light controller 20 generates the appropriate sequence of on-time and off-time for the various traffic lights 24*a*, 24*b*, 24*c*, and 24*d* and pedestrian lights 22*a*, 22*b*, 22*c*, and 22*d* that respectively control vehicular and pedestrian traffic at the intersection. The traffic light controller 20 also has the capability to be forced by external signals into a preemption mode that activates "green" lights in a specified direction and "red" lights in all other directions, allowing safe passage for emergency vehicles from the "green" direction. The traffic light controller 20 may be a micro-processing circuit driving isolated lamp drivers but discrete designs are also feasible. Some intersections may be more complicated, controlling turn lanes with arrow lights, but the basic principles remain the same.

The intersection control module 10 coupled to the traffic light controller 20 is a microprocessor operated via an intersection control program 35 stored in memory. The intersection control module 10 receives information from the emergency vehicles 12 approaching the intersection via a wireless RF transceiver 40 and antenna 41. This information contains data about the predicted position, heading, and/or other navigation data of the emergency vehicle, and/or its priority-code status 36 (i.e. Code-3, Code-2, or other) (collectively referred to as vehicle information). The intersection control module 10 may receive the vehicle information over a cellular network or any other wireless network conventional in the art.

The intersection control module 10 is further coupled to a real-time status monitor 42 which provides real time status information of the various traffic lights 24*a*-24*d*, pedestrian lights 22*a*-22*d*, and pedestrian buttons. That is, the real-time status monitor receives (i.e., "reads") the output from the traffic light controller 20, pedestrian lights 22*a*-22*d*, and traffic lights 24*a*-24*d*, and transmits the read information to the intersection control module 10. The read information includes, for example, the timing and/or phasing of the traffic and pedestrian lights to allow the intersection control module 10 to monitor the timing of the traffic/pedestrian signal phases to optimize preemption at the intersection.

In order to effectuate preemption at the intersection, the intersection control module 10 performs ETA calculations for the approaching emergency vehicles based on the corresponding vehicle information including predicted vehicle position, heading, and the like. The intersection control module 10 uses the ETA calculations along with the intersection phasing values to optimize preemption at the intersection. That is, the intersection control program makes "time-to-preempt" calculations and "time-to-pedestrian-inhibit" calculations to provide minimal disruption to the normal traffic light controller behavior and to maximize the throughput of emergency vehicles through the intersection as is described in more detailed in the above-referenced U.S. application Ser. No. 10/811,075. If a conflict is detected, such conflict information is transmitted to the emergency vehicles via the local transceiver 40.

In addition to preempting the traffic signals to give priority to the emergency vehicles, the intersection control module 10 also sends signals to emergency display panels 45*a*, 45*b*, 45*c*, and 45*d* (collectively 45) to light and flash large emergency signs with the proper icons at each corner of the intersection showing the position of any approaching emergency vehicle relative to the traffic lanes of the intersection. The intersection control module further interacts with an audio warning module 50 to generate audio messages for delivery via speakers 51*a*-51*d*.

According to one embodiment of the invention, any information received or generated by the intersection module 10 may be transmitted to a central monitoring system such as, for example, a central traffic or fleet management system, via a master transceiver 61 using antenna 61. The wireless transmission may be over any wireless network including, for example, a cellular network. Alternatively, the transmission may be over a wired data communications network such as, for example, a local area network, wide area network, or the like. All or portion of the information may also be transmitted to the emergency vehicles or other intersections via the local transceiver 40.

Figure 3A:
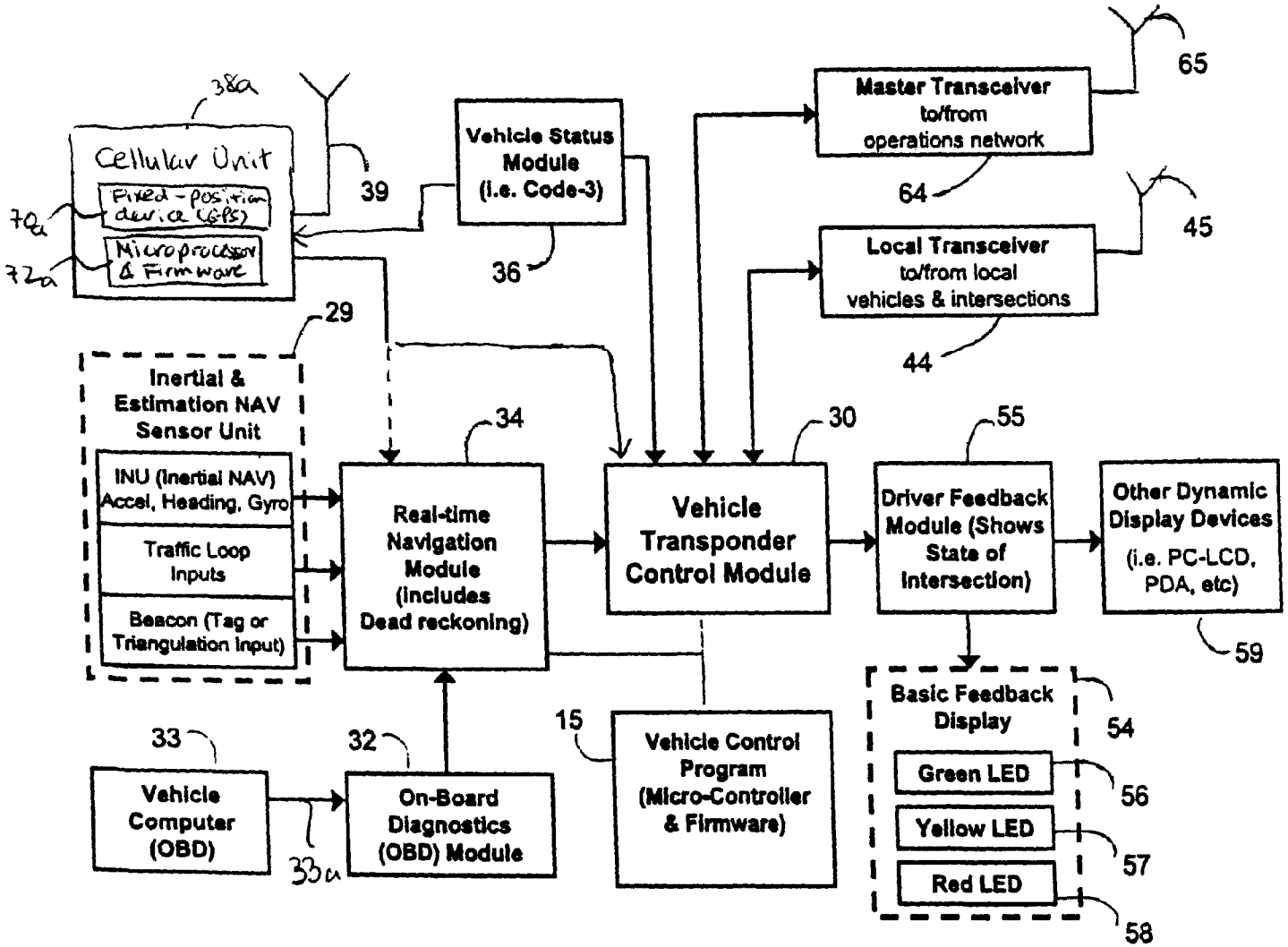
FIG. 3A is a block diagram of various hardware and software modules in communication with a cellular unit in an emergency vehicle according to one embodiment of the invention.

FIG. 3A is a block diagram of various hardware and software modules in communication with a cellular unit 38*a* in an emergency vehicle according to one embodiment of the invention. All or portions of the hardware and software modules are housed within a transponder box installed in the emergency vehicle.

In the illustrated embodiment, the cellular unit 38*a* is equipped with an antenna 39 and a fixed-position device such as, for example, a GPS receiver 70*a*. The GPS receiver 70*a* is configured to generate position reports for the cellular unit within the cellular unit itself. The cellular unit also includes a processor and necessary firmware 72*a* for controlling the different functions of the cellular unit, including the forwarding of the position reports generated by the GPS receiver 70*a* to a vehicle transponder control module 30. The position reports may be forwarded via a wired cable or short-range wireless communication.

The transponder control module 30 functions under the direction of a vehicle control program software 15. The transponder control module 30 receives emergency status information from a vehicle status module 36 when the emergency vehicle is placed in an emergency mode. The status information indicates the priority code (e.g. Code-3) in which the emergency vehicle is operating, and also functions to trigger the cellular unit 38*a* to start transmitting position reports to the transponder control module 30. According to one embodiment of the invention, the vehicle status module 36 is housed within a priority code box installed in the emergency vehicle.

In addition to the position reports from the cellular unit 38*a*, the transponder control module 30 may also optionally receive position inputs from a navigation module 34. Such optional inputs include dead-reckoning INU (inertial navigation and estimation unit 29) parameters including accelerometers, gyroscopes, wheel-tachometers, and heading indicators. Other inputs may include ID tag tracking, beacon triangulation, modified traffic loop detectors, and the like. Vehicle information such as speed and acceleration may also be read in real-time from a vehicle computer 33 using an on-board diagnostic (OBD) interface cable and connector 33*a*. These signals are converted and verified by an OBD circuit board 32 and the translated digital signals are input to the transponder control module 30.

The vehicle control program 15 processes the position data from the cellular unit 38*a* and makes any corrections to the position data based on the data from the navigation module 34. The vehicle control program then generates a predicted vehicle heading and position from the processed data. The vehicle information is then transmitted to intersections and vehicles within a desired area of coverage via a wireless local transceiver 44 and antenna 45 installed in the transponder box.

The local transceiver 44 and antenna also receives incoming preempt alerts and verifications from the intersections, and vehicle position reports from nearby emergency vehicles. The preempt alerts and verifications are forwarded to the transponder control module 30 which invokes a driver feedback module 55 to activate one or more LEDs 56, 57, or 58 on LED display 54 to display lights that correspond to the feedback message. For example, if the feedback message is a signal for safe passage through an intersection, the "green" LED 56 is illuminated. If another high-priority emergency vehicle is concurrently trying to preempt the same intersection, the "yellow" LED 57 is illuminated. Illumination of the "red" LED 58 indicates that there is no preemption at the intersection.

All or portion of the information received or generated by the transponder control module 30 is made available in real time to a central monitoring system such as, for example, a central traffic or fleet management system, via a master transceiver 64 and antenna 65 located in the transponder box. In this manner, the position of the emergency vehicles as well as the status at an intersection is always available at some centrally located dispatch station.

Figure 3B:
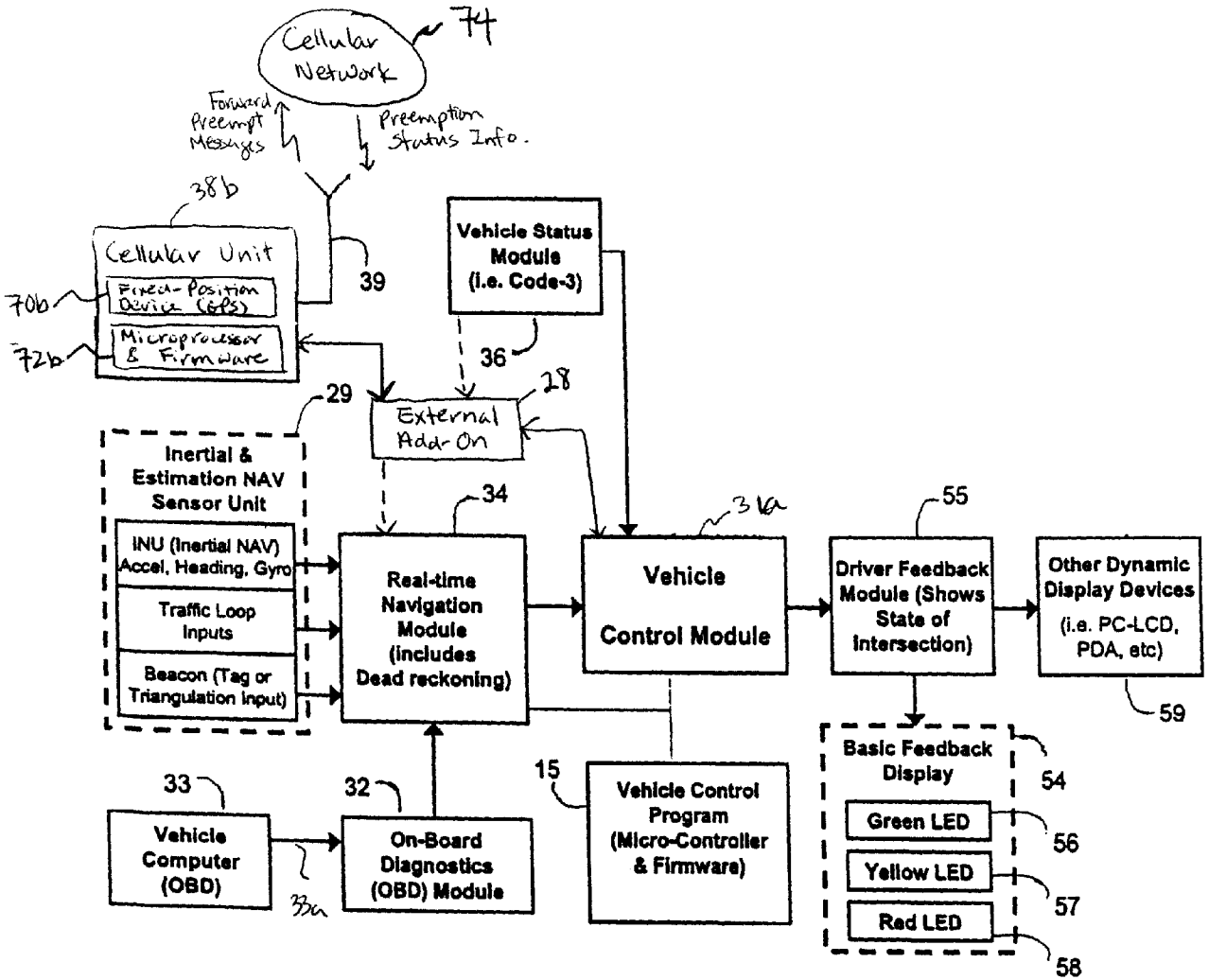
FIG. 3B is a block diagram of various hardware and software modules in communication with a cellular unit in an emergency vehicle according to an alternative embodiment of the invention.

FIG. 3B is a block diagram of various hardware and software modules in communication with a cellular unit 38*b* in an emergency vehicle according to an alternative embodiment of the invention. This embodiment eliminates the local and master transceivers 44, 64 in the transponder box of FIG. 3A, and instead, uses the cellular unit 38*b* to communicate with other emergency vehicles, intersections, and central monitoring systems, over a cellular network 74.

In this regard, the cellular unit 38*b* includes a processor and firmware 72*b*, including the necessary transceivers, for communicating over the cellular network 74. The emergency vehicle also includes an external add-on device 28 for interfacing with a vehicle control module 31*a* which is similar to the transponder control module 30 of FIG. 3A. The external add-on device 28 may attach, for example, to an existing data port of the cellular unit 38*b*.

The vehicle control module 31*a* receives emergency status information from the vehicle status module 36 and generates a trigger signal which is transmitted to the cellular unit 38*b* via the external add-on device 28. Alternatively, the trigger signal may be transmitted by the vehicle status module 36 directly to the cellular unit 38*b* via the external add-on device 28.

The vehicle control module 31*a* also receives position reports from the cellular unit 38*b* via the external add-on device 28, and generates vehicle information based on the position data as well as other navigation data received from the navigation module 34. The vehicle information is then transmitted back to the cellular unit 38*b* for transmitting to the intersections and/or other emergency vehicles over the cellular network 74.

Preemption alerts and verifications from the intersections, and vehicle position reports from nearby emergency vehicles are also received over the cellular network 74 via the cellular unit 38*b* and forwarded to the vehicle control module 31*a* using the external add-on device 28.

Figure 3C:
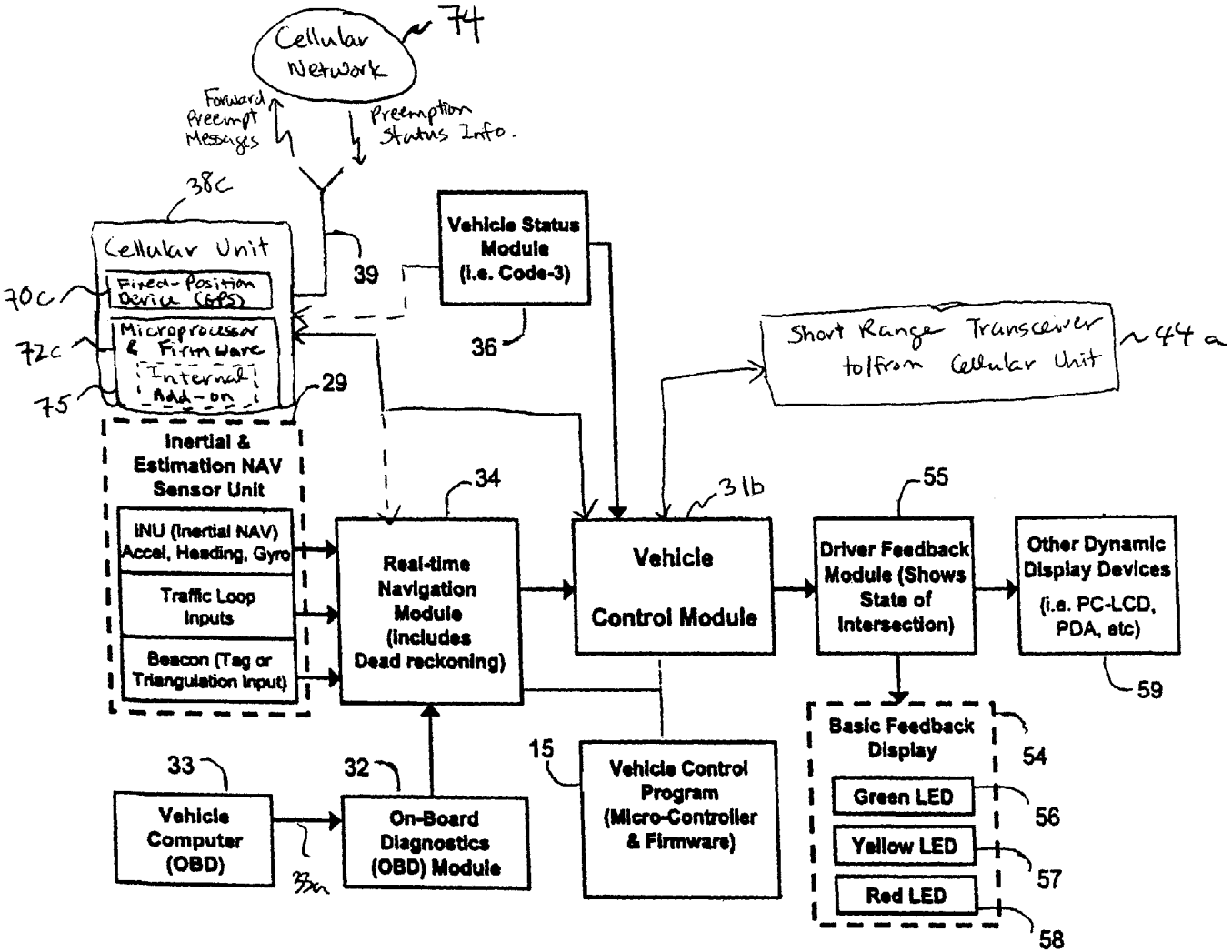
FIG. 3C is a block diagram of various hardware and software modules in communication with a cellular unit in an emergency vehicle according to yet another alternative embodiment of the invention.

FIG. 3C is a block diagram of various hardware and software modules in communication with a cellular unit 38*c* in an emergency vehicle according to yet another alternative embodiment of the invention. This embodiment is like the embodiment of FIG. 3B, except that it eliminates the external add-on device 28. Instead, an internal add-on 75 embedded in the firmware 72*c* and software of the cellular unit is utilized to interface the cellular unit 38*c* to a vehicle control module 31*b* which may be similar to the vehicle control module 31*a* of FIG. 3B. For example, the cellular unit 38*c* may be embedded with a private area network (e.g. Bluetooth) transceiver and associated software that allows the cellular unit 38*c* to wirelessly exchange information with the vehicle control module 31*b* without a need for the external add-on device 28. In this regard, a short-range transceiver 44*a* coupled to the vehicle control module 31*b* is used to communicate with the transceiver in the cellular unit 38*c*.

In both the embodiments of FIGS. 3B and 3C where the cellular unit 38*b*, 38*c* transmits and receives preemption-related data over the cellular network 74, the processor 72*b*, 72*c* in the cellular unit is programmed to transmit and receive the data without disabling use of the cellular unit for an active call. That is, an emergency responder may use the cellular unit to initiate or receive a voice or data call over a voice or data channel or frequency as part of the traditional usage of the cellular unit. According to one embodiment of the invention, this is achieved by piggy-backing the transmission of vehicle information onto diagnostic or other continuously repeating data packets transmitted by the cellular unit 38*b*, 38*c* over, for example, a control channel. According to another embodiment of the invention, preemption-related data may be considered "critical data" during national or regional emergencies, and a portion of cellular channels or subcarrier frequencies may be allocated only to these messages.

In all of embodiments discussed above, the cellular unit 38*a*-38*c* (collectively 38) receives a triggering signal directly or indirectly from the priority code box in the emergency vehicle that houses the vehicle status module 36, in order to cause the cellular unit to transmit the position reports. According to one embodiment of the invention, communication of the triggering signal may be accomplished via additional hardware that includes a wired cable to the cellular unit 38 or its cradle housing. The communication may also be carried out via a short-range transmitter coupled to the vehicle status module 36 and a receiver on the cellular unit 38. The communication may alternatively be accomplished without additional hardware by using a short-range cellular-compatible transmitter/receiver pair and embedded protocol firmware on the cellular unit. For example, Bluetooth chipsets may be utilized to communicate with the vehicle status module 36. For vehicles that lack a priority code box, a special "preemption-only" control box may be installed. The code box and preemption-only control box may be directly activated via switch options on the boxes to place the emergency vehicle in the appropriate emergency mode. Alternatively, the cellular unit's user interface may be used to trigger the generation and/or transmission of the position reports.

According to one embodiment of the invention, the driver feedback module 55 controlling the LED display to provide feedback to a driver via the LED lights may also be coupled to other dynamic display devices 59, such as, for example, external LCDs, PDAs, and the like. In addition, the cellular unit's 38 own display may be used to display feedback information. The cellular unit's audio devices may also be invoked to provide audio messaging. For instance, a visible and/or audible warning from the cellular unit 38 may indicate, for example, "preemption conflict detected at Main and 1st," to inform an emergency responder that another emergency vehicle may be preempting the same intersection. Other feedback may also be provided on the preemption status of all nearby intersections, the locations of both active and inactive emergency vehicles, and the overall health of the preemption system. The displays may also provide a monitor, command, and control interface for mobile operation centers. The preemption status information may also be re-routed to civilian vehicles through consumer cellular in-vehicle units, and used with motorist in-vehicle visual and warning systems as described in further detail in the above-referenced U.S. application Ser. No. 10/696,490.

According to one embodiment of the invention, if the cellular unit 38 is not equipped with a GPS receiver or the GPS receiver or overall GPS system is unavailable (e.g. areas densely covered by trees/buildings or during terrorist attacks), the position of the cellular unit is determined by the cellular station 16 via one of various cellular location determination mechanisms. Such mechanisms use a triangulation algorithm to determine the location of the cellular unit. In doing so, it considers factors such as, for example, angle of approach of the cellular unit to the cellular station, the time it takes a signal to travel to various cellular stations, and the strength of the signal when it reaches the respective cellular stations. An exemplary cellular location determination mechanism is described in further detail in U.S. Pat. No. 5,890,068, the content of which is incorporated herein by reference.

According to one embodiment of the invention, the position reports provided by the GPS receiver or via triangulation may need to be verified or may lack accuracy. In this scenario, different refinement techniques are used to determine preemption at a particular intersection. Such techniques include statistical preemption, map-matching, dead-reckoning and augmented navigation, and preemption optimization techniques.

The intersection control module 10 at an intersection implements statistical preemption by calculating a likelihood that an emergency vehicle will cross the intersection. The likelihood calculation is performed based on analysis of road geography, type of intersection, and historical trends. According to one embodiment of the invention, this information is collected and maintained by the intersection control module 10 for each intersection. The likelihood computation is then balanced against several weighted criteria including the maximum target utilization for the intersection (which may depend on the size of the intersection), the priority of the emergency vehicle, and the ETA of the vehicle. The maximum target utilization is the probability at any given time that an emergency vehicle is preempting the intersection. For example, a 5% probability could be used.

Statistical preemption is based on an assumption that minor emergency preemption disruptions at any given traffic signal are rarely noticed by pedestrians or motorists. Thus, even if the intersection control module 10 determines that there is only a 50% probability that an emergency vehicle is going through an intersection, the traffic lights at the intersection may nonetheless be preempted to give right-of-way to the emergency vehicle.

Statistical preemption is directly related to the use of cellular triangulation-based position determination because it increases the allowable position error margin. It allows the intersection control module 10 to trigger far in advance of an emergency vehicle. If the emergency vehicle position report is not accurate, an error cushion is added to the statistical preemption time. This applies to both ingress ("enable" preemption) and egress ("disable" preemption) events. Statistical preemption is also correlated and enhanced with preemption optimization such as, for example, pedestrian inhibit functions, as is described in further detail below.

Intelligent map-matching includes comparing vehicle navigation (e.g. heading) and position estimates with approach paths taking the form of cross-streets stored locally as map vectors at the intersections. Map-matching allows the intersection control module 10 to determine if any vehicle is on an inbound course towards the intersection by "snapping" it to the closest street and to the closest street heading. Thus, map-matching helps make up for any deficiencies in the position estimates of the emergency vehicles. According to one embodiment of the invention, the position errors that may be tolerated with map-matching are in the order of ¼-½ block, and 20-40 degrees for vehicle heading.

In addition, the position errors may be corrected via dead-reckoning and augmented navigation devices in the emergency vehicles. Dead-reckoning inputs from the INU 29 may include accelerometers, gyroscopes, wheel-tachometers, and heading indicators. Enhanced position estimates are also possible based on separate beacon triangulation as discussed in further detail in the above-referenced U.S. patent application Ser. No. 10/704,530, or based on traffic loops as discussed in further detail in the above-referenced U.S. patent application Ser. No. 10/410,582. Furthermore, vehicle speed and acceleration information may be read from the vehicle computer 33 and used to augment and/or correct the position information generated via triangulation calculations.

Optimized preemption calculations also help make up for any errors in position estimates of the emergency vehicles. As described in the above-referenced U.S. application Ser. No. 10/811,075, the intersection module 10 is configured to monitor all four lanes of an intersection including the pedestrian buttons, to have full intelligence on what the intersection is doing and the timing of the phases of the intersection and pedestrian lights. The intersection control module 10 performs calculations on a constant basis, such as, for example, every second, to determine an ETA of all active emergency vehicles approaching the intersection. The intersection control module 10 triggers the traffic light controller 20 to go into a preemption mode taking into account the calculated ETA as well as the current phase, time interval between the phases, pedestrian clearance times, delays of the traffic light controller, hysteresis-based (historical dependence) statistical algorithms, and the like. The monitoring of the pedestrian lights and pedestrian clearance time also allows the intersection control module 10 to transmit a pedestrian inhibit signal to prevent the pedestrian button from being activated to prevent pedestrian traffic if the traffic signals at the intersection are to be preempted.

In this manner, the intersection control module 10 may preempt an intersection when a vehicle is highly likely of actually crossing the intersection. This has the effect of minimizing the total time the traffic light controller must stay in preemption mode. Preemption optimizing also has the effect of increasing the time-window in which a preemption is decision is made, and likewise increases the error allowable in position reports by such methods as cellular-based triangulation calculations.

Thus, even in the absence of a fixed-position source such as a GPS receiver, position information of the cellular units 38 may nonetheless be determined via triangulation calculations. Any inaccuracies of such calculations may then be made up by the various refinement mechanisms discussed above.

Figure 4:
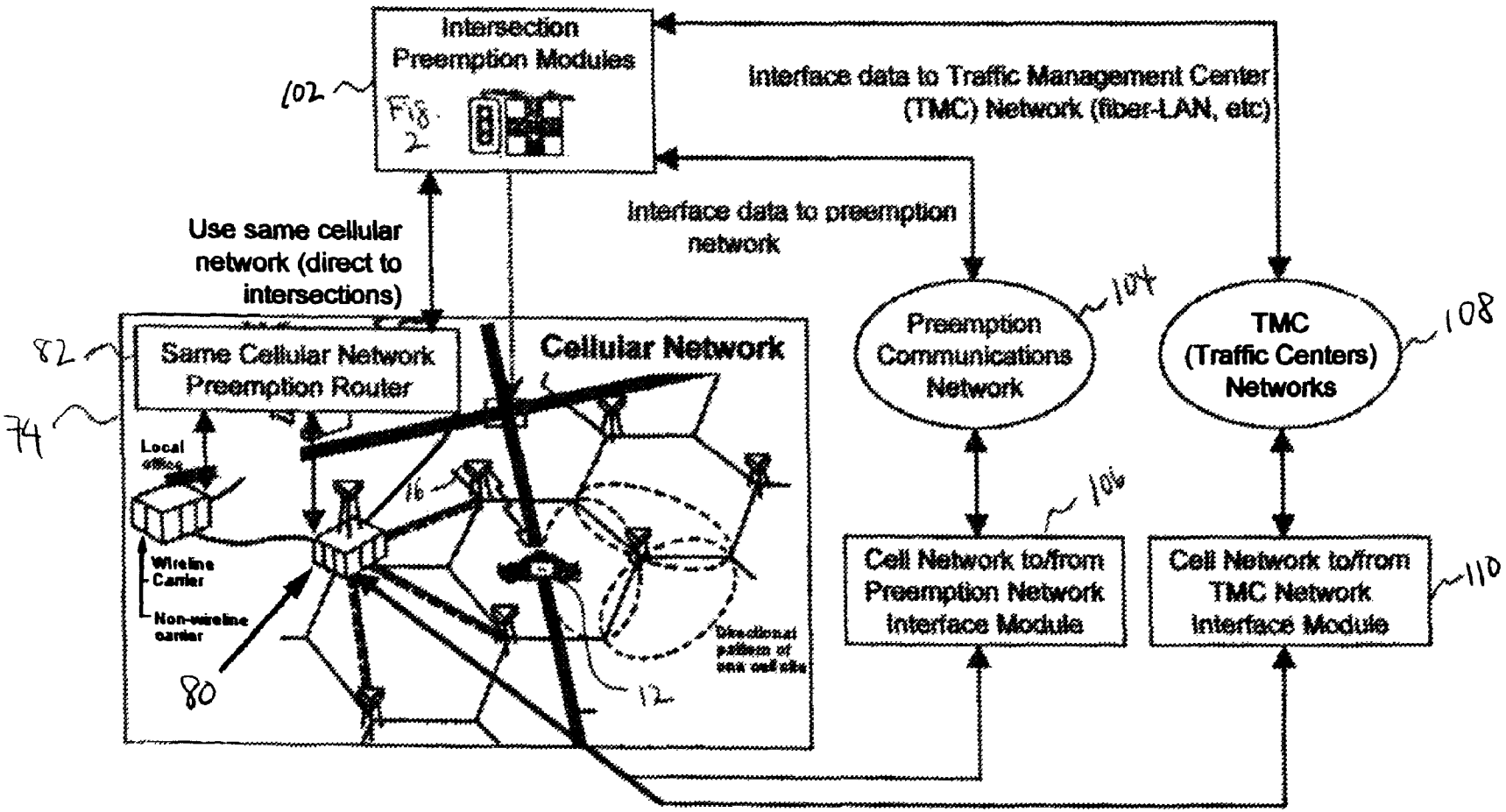
FIG. 4 is a schematic diagram illustrating various options for using a cellular network for routing preemption related data as is contemplated by the embodiments in FIGS. 3B and 3C.

FIG. 4 is a schematic diagram illustrating various options for using the cellular network 74 for routing preemption related data as is contemplated by the embodiments in FIGS. 3B and 3C. These options apply regardless of whether the position data is generated within the cellular units 38*b*, 38*c*, or by the cellular station 16 based signals received from the cellular units 38*b*, 38*c*.

If the position reports are generated by the cellular units 38*b*, 38*c*, vehicle information including position estimates from the position reports generated by the cellular units are transmitted over the cellular network 74 to one or more cellular stations 16. Information for identifying the transmitting cellular unit may also be transmitted prior to or concurrently with the position reports.

If the position reports are generated by the cellular station(s) 16, the cellular unit transmits a position request to the cellular station(s) over the cellular network 74. The position request may include, for example, information for identifying the requesting cellular unit.

The cellular stations forward the generated or received vehicle information to a switching office 80. From the switching office, the vehicle information may be forwarded to the intersection preemption modules 102, other emergency vehicles in the area, and/or to a central monitoring system, in one of various ways.

According to one embodiment of the invention, the switching office uses the same cellular network 74 used to receive the vehicle information from the cellular units 38*b*, 38*c* or cellular stations 16, to forward the vehicle information to the appropriate intersection preemption modules 102, other emergency vehicles in the area, and/or to a central monitoring system. The cellular network 74 is also used to receive and forward feedback data and other preemption related data from the intersection preemption modules 102 and/or central monitoring systems.

According to this embodiment, the intersection modules and/or central monitoring systems are equipped with cellular units which act as the primary communication device for receiving and transmitting preemption relation data. In addition, the cellular network 74 includes a preemption router 82 that is coupled to the switching office 80. The router may take the form of any conventional router configured to route radio signals over the cellular network 74.

According to one embodiment of the invention, the router is programmed to identify and route preemption related data to the intersection preemption module 102 as well as emergency vehicles in the area. In this regard, the router 82 keeps a list of subscribing cellular units 38 along with any position information available for those cellular units 38. The router 82 also keeps a list of known intersection preemption modules 102 and central management systems along with their location information. The router determines the appropriate emergency vehicles, intersection preemption modules, and/or central monitoring systems that may appropriately receive the preemption related data during preemption of a particular intersection.

According to another embodiment of the invention, vehicle information received by the switching office 80 is re-directed to a separate preemption communications network 104 via an interface module 106 for forwarding to the appropriate intersection modules 102. In a similar manner, feedback and other preemption related data is transmitted over the preemption communications network 104 but re-directed to the cellular network 74 for forwarding to the appropriate emergency vehicles.

The preemption communications network 104 may be a local area network, private wide area network, and the like, implemented using any wired or wireless technology known in the art. The interface module 106 is equipped with the necessary hardware and software for providing the wired or wireless interface, as well as for bi-directional packet conversion between the cellular network 74 and the preemption communications network 104. That is, the interface module converts a packet formatted for being transported over a cellular network to a packet formatted for being transported over the preemption communications network.

According to another embodiment of the invention, vehicle information received by the switching office 80 is re-directed to existing traffic center networks 108 via an interface module 110 for forwarding to the appropriate intersection modules 102. In a similar manner, feedback and other preemption related data is transmitted over the existing traffic center networks 108 but re-directed to the cellular network 74 for forwarding to the appropriate emergency vehicles.

According to one embodiment of the invention, the traffic center networks are controlled by local or regional traffic and/or fleet management centers which may perform one or more of the preemption decisions made by the intersection control modules 10 as is described in further detail in the above-referenced U.S. application Ser. No. 10/965,408.

The traffic center networks 108 may be local area networks, private wide area networks, and the like, implemented using any wired or wireless technology known in the art such as, for example, a fiber-LAN. The interface module 110 is equipped with the necessary hardware and software for providing the wired or wireless interface, as well as for bi-directional packet conversion between the cellular network 74 and the traffic center networks 108.

According to one embodiment of the invention, all of the above network routing options provide the vehicle information to the appropriate intersections on a real-time basis (e.g. 1-Hz to 0.3-Hz). Minimal propagation delay (e.g. less than 3 secs) is expected between time of position measurement and time of data arrival for each intersection.

According to one embodiment of the invention, an additional layer of security is provided to the various routing options to prevent abuse and ensure secure communications. For in-vehicle interfacing between the cellular unit 38 and the vehicle/transponder control module 30, 31*a*, 31*b*, the secure communication may be implemented as a standard hard-line encryption data stream. For communication within the cellular network 74, or between the cellular network 74 and the preemption communication network 104 or traffic center networks 108, existing framework and functionality available within each network is used to achieve the secure communications. Security measures may include, for example, encryption of all communication, auto-rotating identification tags for each car, override real-time enabling and disabling of vehicle IDs, and reporting and logging of all preemption activity.

Figure 5:
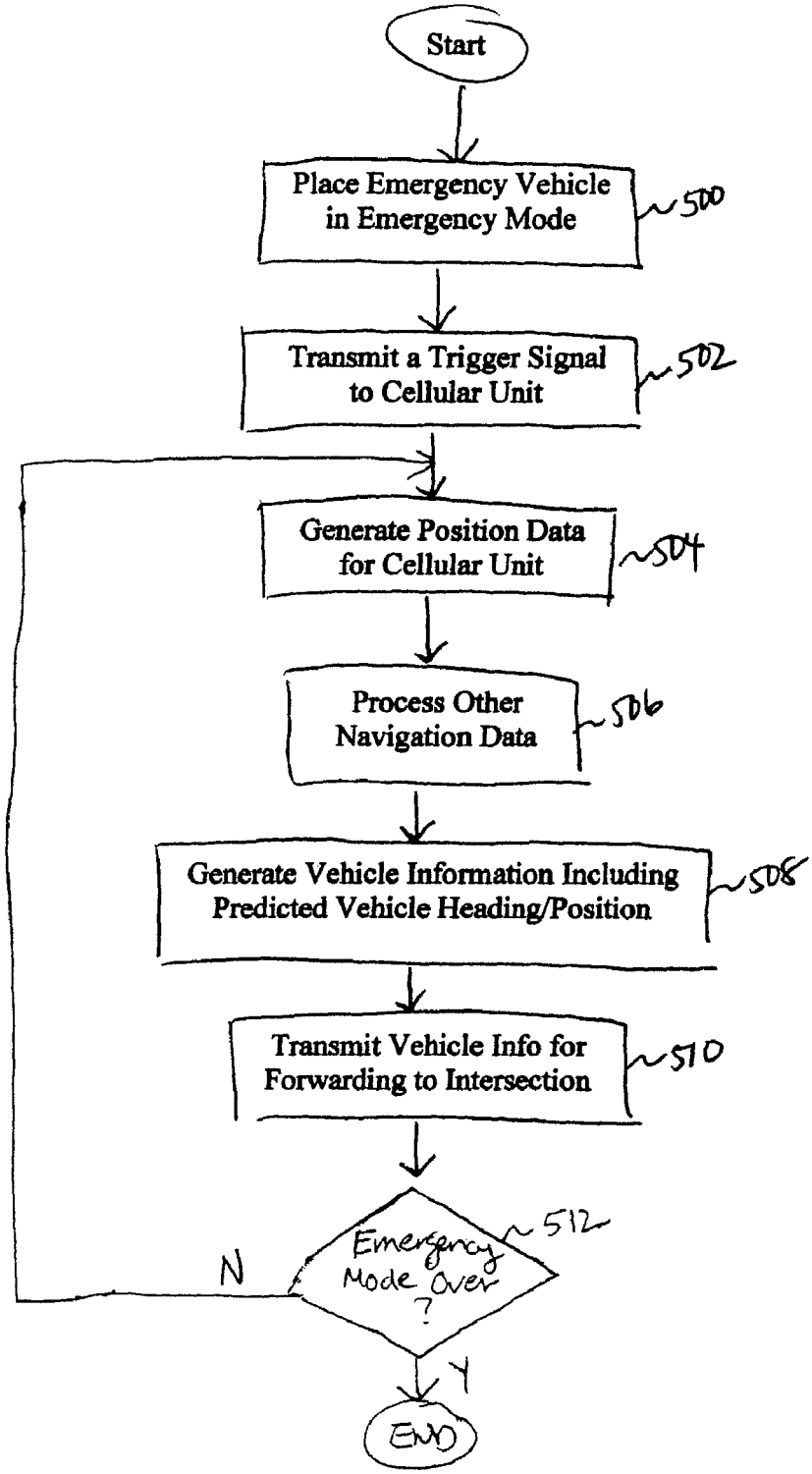
FIG. 5 is a flow diagram of a process for generating and transmitting vehicle information according to one embodiment of the invention.

FIG. 5 is a flow diagram of a process for generating and transmitting vehicle information according to one embodiment of the invention. The process starts with an emergency responder receiving an emergency request. In response to the emergency request, the emergency responder manipulates inputs of the priority code box to select an appropriate priority code. The vehicle status module 36 in the priority code box receives the user's commands and transmits it to the vehicle/transponder control module 30, 31*a*-31*b* which places the emergency vehicle, in step 500, in the selected priority code.

In step 502, the vehicle status module 36 or vehicle/transponder control module 30, 31*a*-31*b* transmits a trigger signal to the cellular unit 38. In response, position data for the cellular unit starts to be generated in step 504. The position data may be generated by the cellular unit itself via the GPS receiver 70*a*, 70*b*, 70*c*. Alternatively, the position data may be generated by the cellular station 16 using triangulation calculations based on the RF signals received from the cellular unit 38. In the latter embodiment, the cellular unit 38 receives the trigger signal and in response, transmits a position request to the cellular station.

In step 506, the vehicle/transponder control module 30, 31*a*-31*b* receives other navigation/position parameters from the navigation module 34 and makes any corrections to the position data from those parameters.

In step 508, the vehicle/transponder control module 30, 31*a*-31*b* generates vehicle information including predicted vehicle heading and/or position from the processed data.

In step 510, the vehicle information is then transmitted for forwarding to the intersection(s). According to one embodiment of the invention, the vehicle information is transmitted via the local transceiver 44 in the emergency vehicle. According to another embodiment of the invention, the vehicle information is transmitted via the cellular unit 38*b*, 38*c* over the cellular network 74

In step 512, a determination is made as to whether the emergency mode is over 512. In this regard, the vehicle status module 36 monitors the inputs to the priority code box for cancellation of the current priority code status. Position data for the cellular unit is continuously generated (e.g. every second) until such input is detected.

A person of skill in the art will appreciate that by leveraging the infrastructure already built around the cellular industry, a cellular-based preemption system becomes much more affordable and easier to maintain for the average emergency response department. Instead of installing specialized hardware and communications systems, departments can now use existing cellular units in a dual-use role, with the majority of the cost already factored in their budget.

Although this invention has been described in certain specific embodiments, those skilled in the art will have no difficulty devising variations to the described embodiment which in no way depart from the scope and spirit of the present invention. Furthermore, to those skilled in the various arts, the invention itself herein will suggest solutions to other tasks and adaptations for other applications. It is the applicants intention to cover by claims all such uses of the invention and those changes and modifications which could be made to the embodiments of the invention herein chosen for the purpose of disclosure without departing from the spirit and scope of the invention. Thus, the present embodiments of the invention should be considered in all respects as illustrative and not restrictive, the scope of the invention to be indicated by the appended claims and their equivalents rather than the foregoing description.

What is claimed is:

1. A system for controlling traffic for allowing passage of an emergency vehicle through an intersection controlled by traffic signals, the system comprising:

means for placing the emergency vehicle in an emergency mode;

means for transmitting a trigger signal responsive to the emergency vehicle being placed in the emergency mode;

a cellular unit in the emergency vehicle receiving the trigger signal and in response, generating position data for the cellular unit; and a control device in the emergency vehicle receiving the position data from the cellular unit, vehicle information based on the position data, and transmitting the vehicle information to the cellular unit;

wherein, the cellular unit forwards the vehicle information to an intersection control unit via a cellular network for controlling the traffic signals at the intersection, wherein the intersection control unit is configured to control the traffic signals based on an estimated time of arrival of the emergency vehicle, the estimated time of arrival being calculated based on the vehicle information received from the cellular unit via the cellular network.

2. The system of claim 1, wherein the intersection control unit is further programmed to:

receive the generated vehicle information;

calculate the estimated time of arrival of the emergency vehicle based on the vehicle information; and transmit one or more preemption commands for preempting the traffic signals based on the estimated time of arrival.

3. The system of claim 2, wherein the intersection control unit is further programmed to:

receive real time status information of the traffic signals;

monitor timing of traffic signal phases based on the received real time status information; and transmit the one or more preemption commands based on the monitored timing of the traffic signal phases.

4. The system of claim 1, wherein the cellular unit includes a global positioning system (GPS) receiver for generating the position data.

5. The system of claim 1, wherein the cellular unit forwards the vehicle information without disabling use of the cellular unit for an active call.

6. The system of claim 1 further comprising:

an on-board diagnostics circuitry coupled to the emergency vehicle and providing vehicle speed and acceleration, wherein preemption of the traffic signals is based the vehicle speed and acceleration.

7. The system of claim 1 further comprising:

one or more navigation sensor units coupled to the emergency vehicle and providing vehicle navigation data, wherein preemption of the traffic signals is based on the vehicle navigation data.

8. The system of claim 1, wherein the vehicle information includes one of predicted vehicle position and heading.

9. A system for controlling traffic for allowing passage of an emergency vehicle through an intersection controlled by traffic signals, the system comprising:

means for placing the emergency vehicle in an emergency mode;

means for transmitting a trigger signal responsive to the emergency vehicle being placed in the emergency mode;

a cellular unit in the emergency vehicle receiving the trigger signal and in response, transmitting a location request to a cellular station, wherein, the cellular station is configured to receive the location request, generate position data of the cellular unit in response to the location request, and transmit the position data to the cellular unit; and a control device in the emergency vehicle receiving the position data from the cellular unit, generating vehicle information based on the position data, and transmitting the vehicle information to the cellular unit, wherein, the cellular unit forwards the vehicle information to an intersection control unit via a cellular network for controlling the traffic signals at the intersection, wherein the intersection control unit is configured to control the traffic signals based on an estimated time of arrival of the emergency vehicle, the estimated time of arrival being calculated based on the vehicle information received from the cellular unit via the cellular network.

10. The system of claim 9 wherein the intersection control unit is further programmed to:

receive the generated vehicle information;

calculate the estimated time of arrival of the emergency vehicle based on the vehicle information; and transmit one or more preemption commands for preempting the traffic signals based on the estimated time of arrival.

11. The system of claim 10, wherein the intersection control unit is further programmed to:

receive real time status information of the traffic signals;

monitor timing of traffic signal phases based on the received real time status information; and transmit the one or more preemption commands based on the monitored timing of the traffic signal phases.

12. The system of claim 9 further comprising:

an on-board diagnostics circuitry coupled to the emergency vehicle and providing vehicle speed and acceleration, wherein preemption of the traffic signals is based on the vehicle speed and acceleration.

13. The system of claim 9 further comprising:

one or more navigation sensor units coupled to the emergency vehicle and providing vehicle navigation data, wherein preemption of the traffic signals is based on the vehicle navigation data.

14. The system of claim 9, wherein controlling of the traffic signals is based on computation of a statistical likelihood of the emergency vehicle crossing the intersection.

15. The system of claim 9, wherein controlling of the traffic signals is based on intelligent map-matching.

16. A control device in an emergency vehicle for allowing passage of the emergency vehicle through an intersection controlled by traffic signals, the control device comprising:

a microcontroller coupled to a cellular unit and configured to execute computer program instructions, the computer program instructions including:

receiving position data generated by the cellular unit;

generating vehicle information based on the position data; and transmitting the vehicle information to the cellular unit;

wherein, the cellular unit forwards the vehicle information to an intersection control unit via a cellular network for controlling the traffic signals at the intersection, wherein the intersection control unit is configured to control the traffic signals based on an estimated time of arrival of the emergency vehicle, the estimated time of arrival being calculated based on the vehicle information received from the cellular unit via the cellular network.

17. The system of claim 16, wherein the intersection control unit is further programmed to:

receive the generated vehicle information;

calculate the estimated time of arrival of the emergency vehicle based on the vehicle information; and transmit one or more preemption commands for preempting the traffic signals based on the estimated time of arrival.

18. The system of claim 17, wherein the intersection control unit is further programmed to:

receive real time status information of the traffic signals;

monitor timing of traffic signal phases based on the received real time status information; and transmit the one or more preemption commands based on the monitored timing of the traffic signal phases.

19. The system of claim 16, wherein the vehicle information includes one of predicted vehicle position and heading.

20. A method for controlling traffic for allowing passage of an emergency vehicle through an intersection controlled by traffic signals, the method comprising:

receiving position data generated by a cellular unit;

generating vehicle information based on the position data; and transmitting the vehicle information to the cellular unit;

wherein, the cellular unit forwards the vehicle information to an intersection control unit via a cellular network for controlling the traffic signals at the intersection, wherein the intersection control unit is configured to control the traffic signals based on an estimated time of arrival of the emergency vehicle, the estimated time of arrival being calculated based on the vehicle information received from the cellular unit via the cellular network.

* * * * *

UNITED STATES PATENT AND TRADEMARK OFFICE

CERTIFICATE OF CORRECTION

PATENT NO. : 7,868,783 B2
APPLICATION NO. : 12/420023
DATED : January 11, 2011
INVENTOR(S) : Aaron D. Bachelder It is certified that error appears in the above-identified patent and that said Letters Patent is hereby corrected as shown below:

In the Claims

| | |
|---|---|
| Column 13, Claim 1, line 5 | Before "vehicle" Insert -- generating -- |
| Column 13, Claim 6, line 41 | After "based" Insert -- on -- |

Signed and Sealed this
Sixth Day of December, 2011

David J. Kappos

David J. Kappos
*Director of the United States Patent and Trademark Office*